US007993212B2

(12) United States Patent
Derkacy et al.

(10) Patent No.: US 7,993,212 B2
(45) Date of Patent: Aug. 9, 2011

(54) GOLF TRAINING DEVICE

(76) Inventors: Tom Derkacy, Alsip, IL (US); Chris Chacon, Chicago, IL (US)

( * ) Notice: Subject to any disclaimer, the term of this patent is extended or adjusted under 35 U.S.C. 154(b) by 0 days.

(21) Appl. No.: 12/525,511

(22) PCT Filed: Feb. 1, 2008

(86) PCT No.: PCT/US2008/052753

§ 371 (c)(1),
(2), (4) Date: Apr. 5, 2010

(87) PCT Pub. No.: WO2008/097825

PCT Pub. Date: Aug. 14, 2008

(65) Prior Publication Data

US 2010/0184529 A1 Jul. 22, 2010

Related U.S. Application Data

(60) Provisional application No. 60/888,020, filed on Feb. 2, 2007.

(51) Int. Cl.
*A63B 69/36* (2006.01)

(52) U.S. Cl. ..... 473/279; 473/271

(58) Field of Classification Search ..... 473/218, 473/219, 227, 266, 269, 270, 271, 273, 275, 473/277

See application file for complete search history.

(56) References Cited

U.S. PATENT DOCUMENTS

| | | | | |
|---|---|---|---|---|
| 2,986,398 | A * | 5/1961 | Oliver | 473/173 |
| 4,029,318 | A * | 6/1977 | Boss | 273/390 |
| 4,817,953 | A * | 4/1989 | Ponchak | 473/271 |
| 5,174,576 | A | 12/1992 | Lee | |
| 5,762,189 | A | 6/1998 | Reimers | |
| 6,010,101 | A | 1/2000 | Stein et al. | |
| 6,021,835 | A | 2/2000 | Malott | |
| 6,250,634 | B1 * | 6/2001 | Strain et al. | 273/395 |
| 6,312,345 | B1 | 11/2001 | Pelz | |
| 2006/0148595 | A1 | 7/2006 | Bostock | |

FOREIGN PATENT DOCUMENTS

WO WO/2008/097825 8/2008

* cited by examiner

*Primary Examiner* — Nini Legesse

(74) *Attorney, Agent, or Firm* — Neal, Gerber & Eisenberg LLP

(57) ABSTRACT

A golf training device for limiting the lateral movement of a lower body of a golfer toward a target and indicating lateral movement thereof, including a vertical panel having an upper end and a lower end, the lower end having a protrusion that extends from the lower end for being lodged into the ground and for preventing the horizontal movement of the golf training device when the protrusion is lodged in the ground. The golf training device further including at least one retractable support leg having a first end and a second end, the first end being pivotally attached proximate to the upper end of the vertical panel and the second end having a protrusion attached thereto for being lodged into the ground and preventing the horizontal movement of the golf training device, wherein the golf training device may be set in an operational position and a non-operational position.

4 Claims, 3 Drawing Sheets

GOLF TRAINING DEVICE

CROSS-REFERENCE

The present Non-Provisional Patent Application is a continuation of International Application No. PCT/US2008/052753, filed on 1 Feb. 2008, which claims priority to U.S. Provisional Patent Application 60/888,020 filed on 2 Feb. 2007. Both of the above-mentioned patent applications are hereby incorporated by reference in their entirety.

BACKGROUND OF THE INVENTION

This application relates generally to a golf training device and more specifically, to a freestanding, portable device for limiting lateral movement of the lower body of a golfer toward a target and indicating lateral movement thereof.

Many golf training devices currently exist, however, none of the current devices provide all of the advantages of the present invention. For example, many devices that focus on the lower body of a golfer are not portable and require bulky platforms on which the golfer must stand. In some instances, this requires the golfer to be positioned on a different plane with respect to the ball, or above the ball.

SUMMARY OF THE INVENTION

A golf training device including a vertical panel having an upper end and a lower end, the lower end having a protrusion that extends from the lower end for being lodged into the ground and for preventing the horizontal movement of the golf training device when the protrusion is lodged in the ground. The golf training device further including at least one retractable support leg having a first end and a second end, the first end being pivotally attached proximate to the upper end of the vertical panel and the second end having a protrusion attached thereto for being lodged into the ground and preventing the horizontal movement of the golf training device, wherein the golf training device may be set in an operational position and a non-operational position, and wherein the retractable support leg is set in an angular relationship with the vertical panel when the golf training device is set in an operational position and the retractable support leg is set in parallel relation to the vertical panel when the golf training device is set in a non-operational position.

A better understanding of the objects, advantages, features, properties and relationships of the invention will be obtained from the following detailed description and accompanying drawings which set forth illustrative embodiments that are indicative of the various ways in which the principles of the invention may be employed.

DETAILED DESCRIPTION OF THE DRAWINGS

The following is a description of the multiple embodiments of the present invention. Where appropriate, like numerals indicate identical or substantially identical components.

Figure 1:
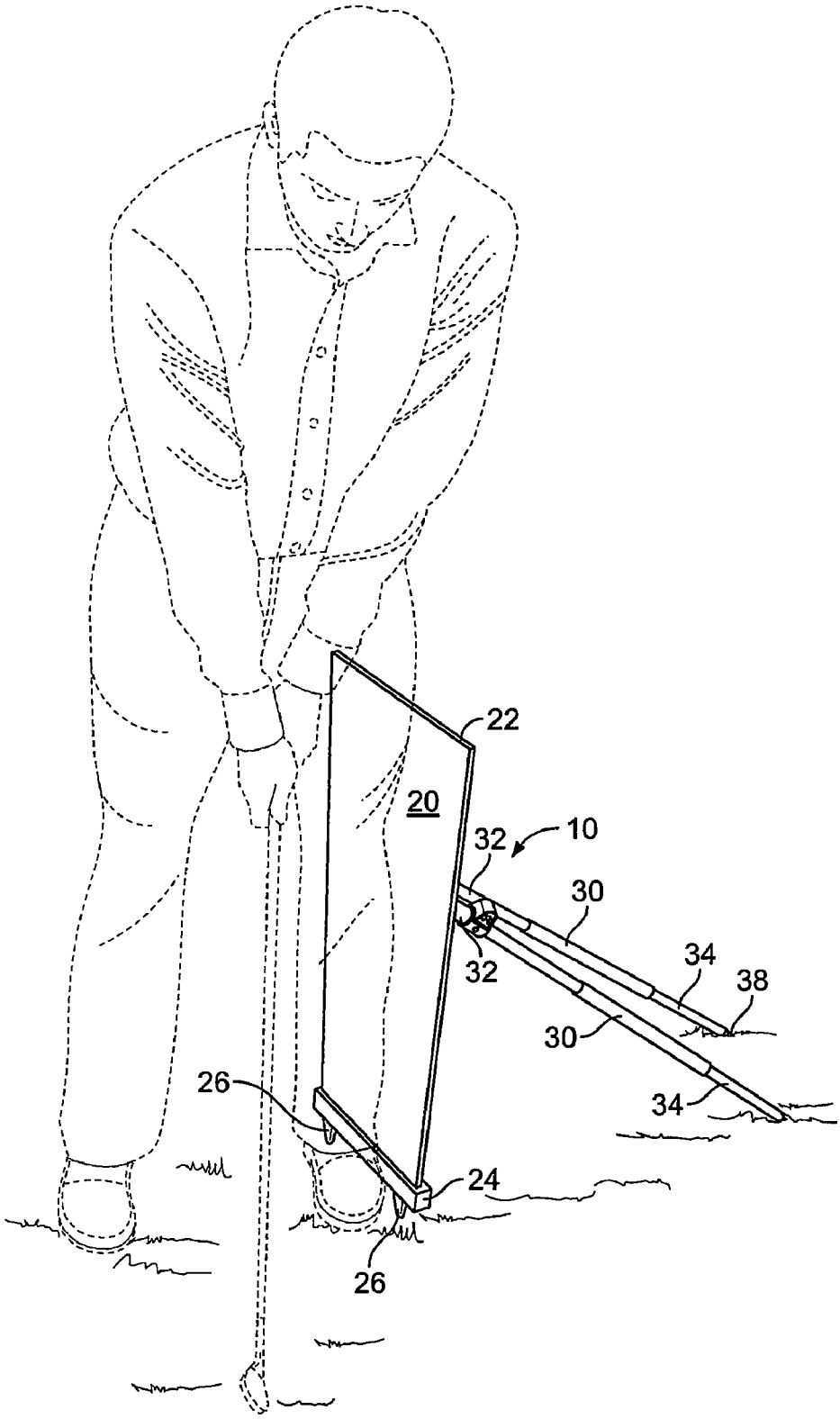
FIG. 1 depicts a perspective view of a first embodiment of the present invention in an operational position.

A golf training device 10 for limiting lateral movement of the lower body of a golfer toward a target and indicating lateral movement thereof is shown in FIG. 1. The golf training device 10 includes a vertical panel 20 and at least one retractable support leg 30. While the embodiment shown in FIG. 1 is intended to indicate the general proportions of the golf training device 10, it will be understood that the drawings are not to scale, and changes to the arrangement and sizing of the components will be obvious to a person of skill in the art. The size of the vertical panel 20 and retractable support leg 30 and the other components will be dictated primarily by the intended applications of the unit and the size of the users that operate the golf training device 10. It should also be noted that the present invention is particularly advantageous because it does not require a platform as support for the vertical panel 20 or the users body weight to atop the platform as an anchor for the device. This is beneficial because it allows the golfer and ball to be on the same plane, as opposed to having situations where the golfer would stand on a platform and therefore, be on a plane that is slightly above the ball. It is also beneficial because it improves the portability of the golf training device 10.

For limiting lateral movement of the lower body of a golfer toward a target, the golf training device 10 is placed in position by the user and removably attached to a golf surface. Moreover, it will be appreciated by those with skill in the art that stabilizing the left leg is advantageous because it prevents the user from turning to far to the left and thereby opening their golf swing, which may lead to problems such as mishitting the ball and/or imparting a slicing spin on the ball.

As shown in FIG. 1, the vertical panel 20 has an upper end 22 and a lower end 24. For fixedly attaching the vertical panel 20 of the golf training device 10 to the golf surface, the vertical panel 20 includes at least one protrusion 26. The protrusion 26 may be a spike, rod or similar means for being lodged in the ground and restricting the horizontal movement of the golf training device 10 and may be positioned on the lower end 24 of the vertical panel 20.

Figure 2:
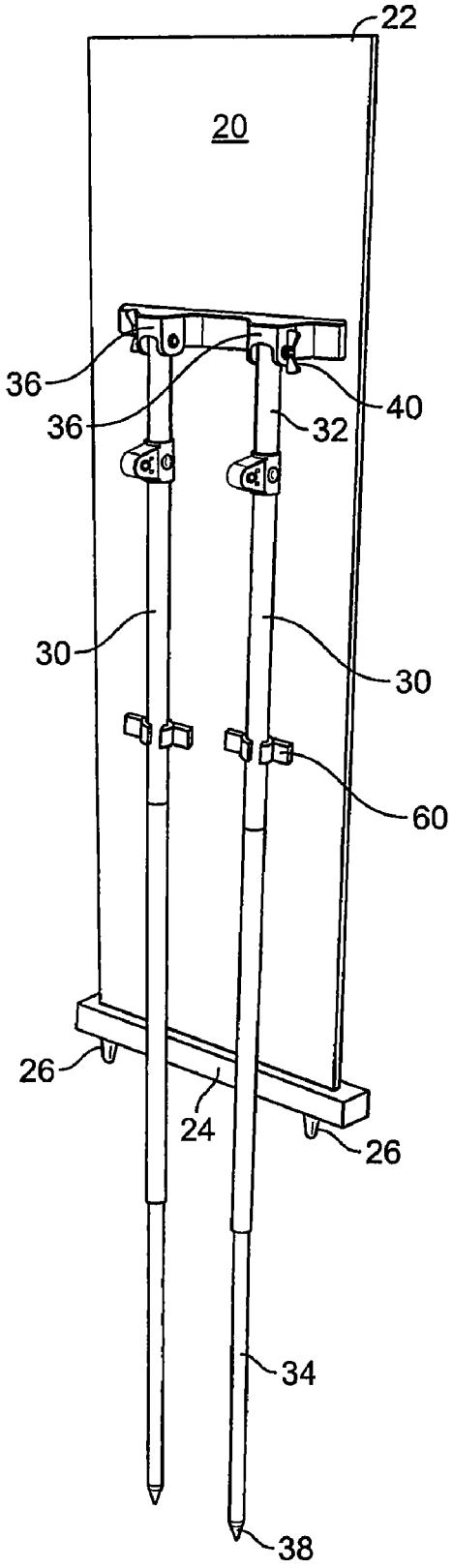
FIG. 2 is a side view of the first embodiment of the invention shown in FIG. 1 in a non-operational position.
Figure 3:
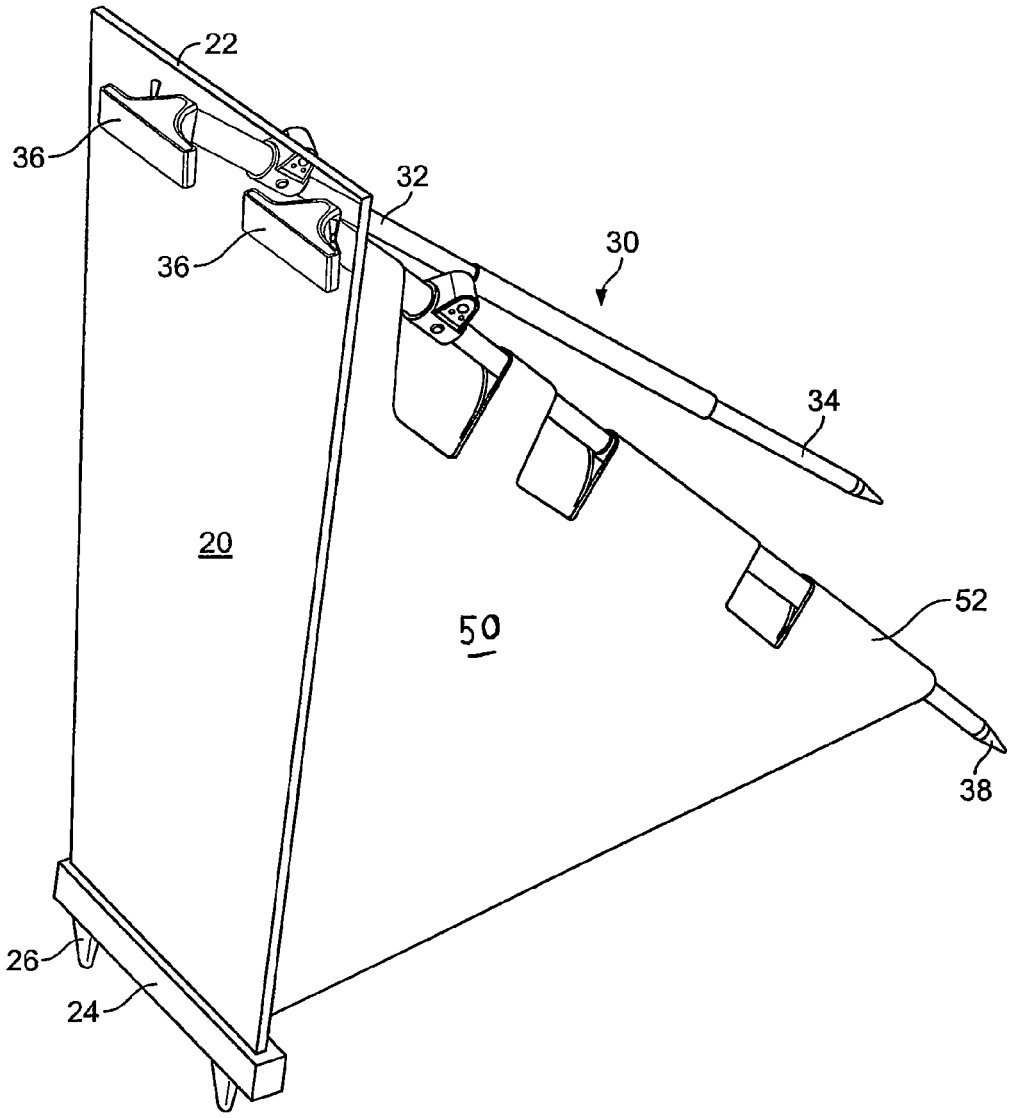
FIG. 3 depicts a perspective view of a second embodiment of the present invention having a flexible wall and telescoping support legs.

To further restrict the horizontal movement of the golf training device 10 and for providing free-standing structural support for the vertical panel 20, at least one retractable support leg 30 may be provided. The retractable support leg 30 includes a first end 32 and second end 34 and a fastener 36 for attaching the first end 32 of the retractable support leg 30 to the vertical panel 20. The retractable support leg 30 also includes at least one protrusion 38 that extends from the distal end of the second end 34 of the retractable support leg 30 for being lodged into the golf surface. Similar to the protrusion 26 attached to the vertical panel 20, the protrusion 38 may be a spike, rod or any similar means capable of being lodged in the ground and restricting the horizontal movement of the golf training device 10. Although FIG. 1 shows the fastener 36 located proximate the upper end 22 of the vertical panel 20, it should be understood that the fastener may also be located at different position on the vertical panel 20 so long as enough support is provided to maintain the upright position of the vertical panel 20. It should also be obvious to those with skill in the art that the fastener 36 for attaching the retractable support leg 30 to the vertical panel 20 may also be a ball and socket, a hinge, a frictional locking device such as a screw and wingnut/thumbwheel, a flexible material, such as rope or wire, or any other means for attaching the retractable support leg 30 to the vertical panel and withstanding moderate levels of blunt force or flexing and that more than one fastener 36 may be used if more than one retractable support leg 30 is employed. If the golf training device 10 includes more than one retractable support leg 30 and more than one fastener 36, it should also be understood that the fasteners 36 may be formed separately (as shown in FIG. 3) or as a single unit (similar to the fasteners shown in FIG. 2).

As shown in FIG. 1, the first embodiment of the present invention shows a vertical panel 20 having two protrusion 26, 38 and two retractable support legs 30. It should be obvious that the number of protrusions 26, 38 and retractable support legs 30 may vary as long as the number is consistent with the need for restricting the horizontal movement of the vertical panel 20 and maintaining the portability of the golf training device 10. The retractable support legs 30 may be comprised of light-weight metal, plastic or any other material that is rigid, durable and light-weight. The retractable support legs 30 may also be extended and contracted in a telescoping manner, which is well known in the industry. Although retractable support legs 30 of a telescoping nature are shown in FIG. 1-3, the retractable support legs 30 may also be of a unitary, non-telescoping construction.

To enhance the portability of the golf training device 10, the retractable support legs 30 may assume operational and non-operational positions. In the operational position and as shown in FIG. 2, the first end 32 of the retractable support leg 30 is attached to the upper end 22 of the vertical panel 20 and the second end 34 of the retractable support leg 30 is extended away from the vertical panel 20 so that the retractable support leg 30 forms an angular relationship with the vertical panel 20. In the non-operational (portable) position and as shown in FIG. 3, the first end 32 of the retractable support leg 30 is attached to the upper end 22 of the vertical panel 20 and the second end 34 of the retractable support leg 30 is removably attached to the lower end 24 of the vertical panel 20 so that the retractable support leg 30 forms a substantially parallel relationship with the vertical panel 20. The second end 34 of the retractable support leg 30 may be attached to the lower end 24 of the vertical panel with a mounting bracket 60 as shown in FIG. 2. The mounting bracket may also be comprised of a hook and loop fasteners (i.e., Velcro®), rope, a tension clip, magnetic fasteners or similar means, or by providing frictional resistance at the fastener 36 in conjunction with a screw and wingnut/thumbwheel, as shown in FIG. 2 and as is well know in the industry.

The retractable support legs 30 may also be designed to automatically extend and retract. Several designs for achieving this function in connection with golf bags exist in the industry. For example, U.S. Pat. Nos. 5,762,189 (the "'189 patent) and 6,010,101 (the "'101 patent") describe and show a set of retractable support legs for use in connection with a golf bag. The '189 and '101 patents, including the portion of the specification that describes the operation and design of the automatically retractable support legs, are hereby incorporated by reference.

A second embodiment of the present invention is shown in FIG. 3. In this embodiment of the golf training device 10, a vertical panel 10, retractable support legs 30 and various protrusions 26 and 38 similar to the first embodiment of the present invention are provided. For slowing the potential impact of a golf club on the retractable support legs 30 and for creating a visual deterrent for avoiding unwanted contact with the retractable support legs 30 and thereby promoting an "in-to-out" golf swing, a flexible material may also be provided for forming a flexible wall 50 on the golf training device 10, as shown in FIG. 3. The flexible wall 50 may include a plurality of fasteners 52 for attaching the flexible wall 50 to the golf training device 10. The fasteners 52 may be constructed of snap-on buttons, hook and loop fasteners (i.e., Velcro®), latches or other means for attaching the flexible material or flexible wall 50 to the golf training device. As shown in FIG. 3, the flexible wall 50, which may be triangular in nature, may also be designed to be attached at one end to the vertical panel 20 and at another end to the retractable support leg 30. The flexible wall 40 may be made of cloth, plastic, or other materials that are light-weight, flexible and inexpensive. For attaching the retractable support legs 30 to the upper end 22 of the vertical panel 20, a screw and wingnut/thumbwheel 40 may be provided. For example, as shown in FIG. 2, once the retractable support legs 30 are set in their proper position, the user may tighten the wingnut 40 and lock the retractable support legs 30 in their desired position, including the operational or non-operational position. In addition, the retractable support legs may be positioned at each of the top corners of the vertical panel 20 to allow the flexible wall 40 to be substantially flush with the outside edge (i.e., the edge that is closest to the ball) of the vertical panel.

As shown in FIG. 1, in order to use the golf training device 10 a golfer/user places the foot of their lead leg (e.g., the leg that is closest to the target) against the lower end 24 of the vertical panel 20. From this position, the golfer takes a normal swing. As will be understood by those with skill in the art, placement of the foot of the lead leg against the lower end 24 of the vertical panel 20 prevents the golfer from turning the left foot toward the target. In addition, the vertical panel 20 extends upwardly past the golfer's knee in most instances, which also limits the lateral movement of the lower body of the golfer. Moreover, when the golfer engages in a normal swing of the golf club, the golfer must use an "in-to-out" golf swing in order to avoid hitting the retractable support leg 30. Therefore, an additional advantage of the present invention is that it forces the golfer to use an "in-to-out" golf swing and reduces the propensity toward slicing the golf shot.

In the second embodiment of the golf training device 10, which is shown in FIG. 3, the flexible wall 50 assists in promoting an "in-to-out" golf swing by creating a visual deterrent to hitting the flexible wall 50 or retractable support leg 30 with the golf club. Moreover, the flexible wall 50 also acts to slow or cushion the impact of the golf club if the golfer accidentally swings the club into the flexible wall 50 or retractable support leg 30. It should evident that the flexible wall 50 may be attached to either side of the golf training device 10 to accommodate right-handed or left-handed golfers and that the golf training device may be utilized by right-handed or left-handed golfers.

While specific embodiments of the invention have been described in detail, it will be appreciated by those skilled in the art that various modifications and alternatives to those details could be developed in light of the overall teachings of the disclosure. Accordingly, the particular arrangement disclosed is meant to be illustrative only and not limiting as to the scope of the invention which is to be given the full breadth of the appended claims and any equivalents thereof.

The invention claimed is:

1. A golf training device for limiting lateral movement of a lower body of a golfer toward a target and indicating lateral movement thereof, comprising:

a vertical panel having an upper end and a lower end, the lower end of the vertical panel further including at least one protrusion extending from the lower end for being lodged into the ground and for preventing the horizontal movement of the golf training device when the protrusion is lodged in the ground;

at least one retractable support leg having a first end and a second end, the first end being pivotally attached proximate to the upper end of the vertical panel and the second end having a protrusion attached thereto for being lodged into the ground and preventing the horizontal movement of the golf training device;

wherein the golf training device may be set in an operational position and a non-operational position;

wherein the retractable support leg is set in an angular relationship with the vertical panel when the golf training device is set in an operational position and the retractable support leg is set in parallel relation to the vertical panel when the golf training device is set in a non-operational position, and;

wherein a removable piece of material is attached to the vertical panel and retractable support leg to create a flexible wall that extends substantially perpendicularly from the vertical panel and within the plane created by the vertical panel, the retractable leg and the ground.

2. A golf training device as set forth in claim 1, wherein the retractable support leg is tubular.

3. A golf training device as set forth in claim 2, wherein the retractable support leg may be extended and compacted in a telescoping manner.

4. A golf training device as set forth in claim 1, wherein the protrusion is a spike.

* * * * *